US007291248B2

(12) United States Patent
Tarkiainen et al.

(10) Patent No.: US 7,291,248 B2
(45) Date of Patent: Nov. 6, 2007

(54) DEWATERING MEMBER WITH A COMPOSITE BODY FOR A PAPER OR BOARD MACHINE AND METHOD FOR MANUFACTURING A DEWATERING MEMBER WITH A COMPOSITE BODY FOR A PAPER OR BOARD MACHINE

(75) Inventors: Veli-Pekka Tarkiainen, Jyväskylä (FI); Liisa Muilu, Jyväskylä (FI); Kirsi Kervinen, Jyväskylä (FI); Petri Sorsa, Tampere (FI)

(73) Assignees: Exel Oyj, Mäntyharju (FI); Metso Paper, Inc., Helsinki (FI)

( * ) Notice: Subject to any disclaimer, the term of this patent is extended or adjusted under 35 U.S.C. 154(b) by 567 days.

(21) Appl. No.: 10/300,210

(22) Filed: Nov. 20, 2002

(65) Prior Publication Data

US 2003/0106663 A1 Jun. 12, 2003

(30) Foreign Application Priority Data

Nov. 21, 2001 (FI) ..... 20012261

(51) Int. Cl.
*D21F 1/00* (2006.01)

(52) U.S. Cl. ..... 162/352; 162/351; 162/374; 15/236

(58) Field of Classification Search ..... 162/352, 162/351, 374; 15/236
See application file for complete search history.

(56) References Cited

U.S. PATENT DOCUMENTS 3,928,125 A * 12/1975 Poeschl ..... 162/352
4,004,969 A * 1/1977 Beauchemin ..... 162/352
4,106,981 A 8/1978 Corbellini
4,425,189 A * 1/1984 Mimura ..... 162/352
6,200,248 B1 3/2001 Vestola et al.
6,497,922 B2 * 12/2002 Knight et al. ..... 427/450

FOREIGN PATENT DOCUMENTS

CH 513 088 9/1971

(Continued)

OTHER PUBLICATIONS

Search Report issued in Finnish Priority No. 20012261, Nov. 2001.

(Continued)

*Primary Examiner*—Mark Halpern
(74) *Attorney, Agent, or Firm*—Stiennon & Stiennon

(57) ABSTRACT

A dewatering member for a paper or board machine has a composite body (13) and a hard surface layer (12). The composite body (13) is manufactured in a pultrusion process. An adhesion layer (11) is formed on desired outer surfaces of the composite body (13) such that reinforcements passed to the adhesion layer (11) have been passed to the pultrusion process through a separate resin bath, to which an adhesion improving agent has been added such that the hard surface layer (12) can be applied directly onto it, and reinforcements forming the inner portion of the composite body (13) have been passed to the pultrusion process through a second resin bath. The composite body (13) is coated with a hard coating layer (12) produced by thermal spraying, and the coating (12) is ground.

17 Claims, 1 Drawing Sheet

FOREIGN PATENT DOCUMENTS

| | | | |
|---|---|---|---|
| FI | 3930/73 | | 12/1973 |
| FI | 84506 | | 8/1991 |
| FI | 87942 | | 12/1991 |
| FI | 940884 | | 2/1994 |
| FI | 943777 | | 8/1994 |
| FI | 971542 | | 4/1997 |
| FR | 2 323 506 | | 4/1977 |
| JP | 58070792 | * | 4/1983 |
| JP | 58070793 | * | 4/1983 |
| WO | WO 91/13204 A1 | | 9/1991 |
| WO | WO 96/04370 A1 | | 2/1996 |
| WO | WO 96/05370 A1 | | 2/1996 |
| WO | WO 97/30212 A1 | | 8/1997 |

OTHER PUBLICATIONS

Search Report issued in EU 02 39 6168.3, Jun. 2002.
English translation of JP-70792, Apr. 1983.
English translation of JP-70793, Apr. 1983.

* cited by examiner

DEWATERING MEMBER WITH A COMPOSITE BODY FOR A PAPER OR BOARD MACHINE AND METHOD FOR MANUFACTURING A DEWATERING MEMBER WITH A COMPOSITE BODY FOR A PAPER OR BOARD MACHINE

CROSS REFERENCES TO RELATED APPLICATIONS

This application claims priority on Finnish Application No. 20012261, Filed Nov. 21, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a dewatering member with a composite body for a paper or board machine and to a method for manufacturing a dewatering member with a composite body for a paper or board machine.

In paper machines, among other things, different suction boxes, loading elements, etc. are used for dewatering, in which boxes and elements a foil structure is often used in which the foils, on the one hand, support or load a wire/felt and, on the other hand, doctor the water being drained from the paper web off the surface of the wire. The foils are subjected to heavy wear against the wire, and therefore the foils shall be made of a material that is especially resistant to wear.

A problem in these prior art arrangements which have used a foil made of a ceramic has also been caused by the fact that ceramic materials do not ordinarily withstand high stresses. The present applications of dewatering devices require relatively narrow foils, which are very difficult to manufacture out of ceramic. Narrow ceramic foils are also very problematic from the standpoint of the stresses caused by loading.

Foils made of ceramic have also been problematic in that ceramic pieces may have risen from the desired level, with the result that the surface level of the foil structure that guides the wire and determines its run is not even any more.

With respect to the prior art, reference is made to FI application publication 940884, which discloses a method for manufacturing a structure comprising a set of foils for a dewatering device of a paper machine, and a structure comprising a set of foils for a dewatering device of a paper machine. In this prior art arrangement, a foil in the structure of a set of foils is attached to a frame structure of a web forming and/or dewatering device or to an equivalent support piece, and the surface of the foil facing the wire has been machined to a desired level or shape, after which the surface of the foil facing the wire has been coated with a ceramic coating, which is in direct contact with the foil body.

With respect to the prior art, reference is also made to FI application publication 943777, which discloses a dewatering member for a paper machine and a method for manufacturing it. In this prior art arrangement, the dewatering member comprises a body and a ceramic wearing surface. The body comprises an elongated profile which forms a bounded space into which it has been possible to cast a flowing material. The body has also included at least one surface for attaching the wearing surface. The body comprises thermoset plastic which fills the bounded space at least partly. The wearing surface is a ceramic coating thermally sprayed onto the surface of the body profile.

Today, the dewatering foils used in paper and board machines are manufactured of piece ceramic attached to a body. Small ceramic pieces made by sintering are attached to the body either mechanically or by gluing. A problem with piece ceramic has been, among other things, the "piano-key effect" in which glued ceramic pieces rise to different levels on the surface of the foil. In that case, the pieces which have risen to a higher level produce harmful marks on the paper web that is being manufactured. One problem with the prior art dewatering members has also been that pieces have become detached or split.

SUMMARY OF THE INVENTION

An object of the invention is to provide a dewatering member in which the drawbacks of the prior art arrangements are eliminated or at least minimized.

An object of the invention is also to provide a dewatering member which is durable and economical to manufacture.

In accordance with the invention, in the manufacturing stage of the composite body of the dewatering member, reinforcements forming a surface layer in a pultrusion process are conveyed through a separate resin bath, into which a powder that improves adhesion has been added, for example, a metal powder, for example, NiCr powder, for example, over 50 wt. %, whereby an adhesion layer is produced on the composite by means of pultrusion, said adhesion layer being, for example, a surface layer which is rich in nickel-chromium and onto which thermal spraying can be directly carried out. Thus, there is no need to add any separate structure to the surface of the foil body at a later stage after the manufacturing process of the composite, for example, a wire mesh or metal wire to enable adhesion of a coating, as needed in the prior art arrangements, but, instead, in accordance with the invention, an adhesion improving agent, for example, a nickel-chromium powder is introduced into the composite already in the pultrusion stage, whereby it is very well locked into the resin fiber structure and does not cause any discontinuity in the structure, which occurs in the applications known in themselves in the prior art, in which a separate resin+filler layer is added to the body at a later stage.

In accordance with the invention, a durable structure having a high mechanical strength is achieved by modifying the fiber structure.

The dewatering members in accordance with the invention comprise a composite body coated with a hard ceramic coating. The ceramic coating is a thermally sprayed ceramic coating which has a high wear resistance and toughness. The adhesion of the hard coating to the composite body is provided by forming an adhesion layer onto the composite body in the pultrusion manufacturing stage, which adhesion layer considerably improves adhesion. In the pultrusion process, the reinforcements which will form the adhesion layer are conveyed through a separate resin bath, into which an adhesion improving agent, for example, a metal, preferably an NiCr or tungsten powder, has been added, said reinforcements being passed in pultrusion to the surface layer of the body.

In accordance with the invention, the dewatering foil with a composite body for a paper or board machine comprises a wear-resistant ceramic surface, which is made, for example, by thermal spraying, whereby a uniform ceramic surface is achieved, so that the problems of the prior art arrangements are not encountered, for example, rising of ceramic pieces to different levels, i.e. the "piano-key effect" known in the prior art, which occurs, for example, in sintered bulk ceramic foils. Cost savings are also achieved by means of the arrangement in accordance with the invention. In connection with the invention, a further benefit is also attained by the use of the pultrusion process enabling continuous manufacture, which is advantageous in respect of its costs. Moreover, ceramic manufactured by thermal spraying can be ground or re-coated, if needed, and it is easier to treat than when prior art piece ceramic is used.

In accordance with one application of the invention, the coating of the composite foil body having a filler incorporated therein takes place such that a nickel-chromium layer is first thermally sprayed onto the surface of the composite, for example, by an HVOF method, onto which layer it is further possible to spray a wear-resistant ceramic, for example, an $Al_2O_3$ or $Cr_2O_3$ or hard metal coating. The sprayed ceramic can be further ground to the required surface roughness value and, when the need arises, it can also be surface-sealed and/or surface-treated.

The invention is suitable for use in connection with different dewatering members of a paper or board machine, for example, in connection with the manufacture of a cover for a felt suction box.

In the following, the invention will be described in more detail with reference to the figures in the appended drawing, but the invention is not by any means meant to be narrowly limited to the details of them.

DESCRIPTION OF THE PREFERRED EMBODIMENTS

Figure 1:
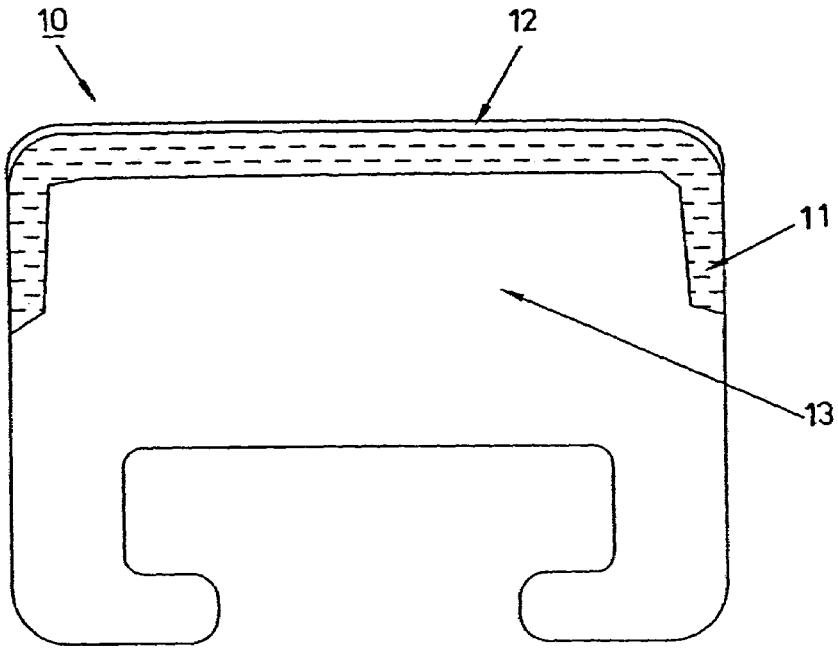
FIG. 1 is a schematic view of a dewatering member of a paper or board machine.

FIG. 1 schematically shows a dewatering member, for example, a foil 10 of a dewatering device, comprising a composite body 13, an adhesion layer 11 and a hard coating 12.

Figure 2:
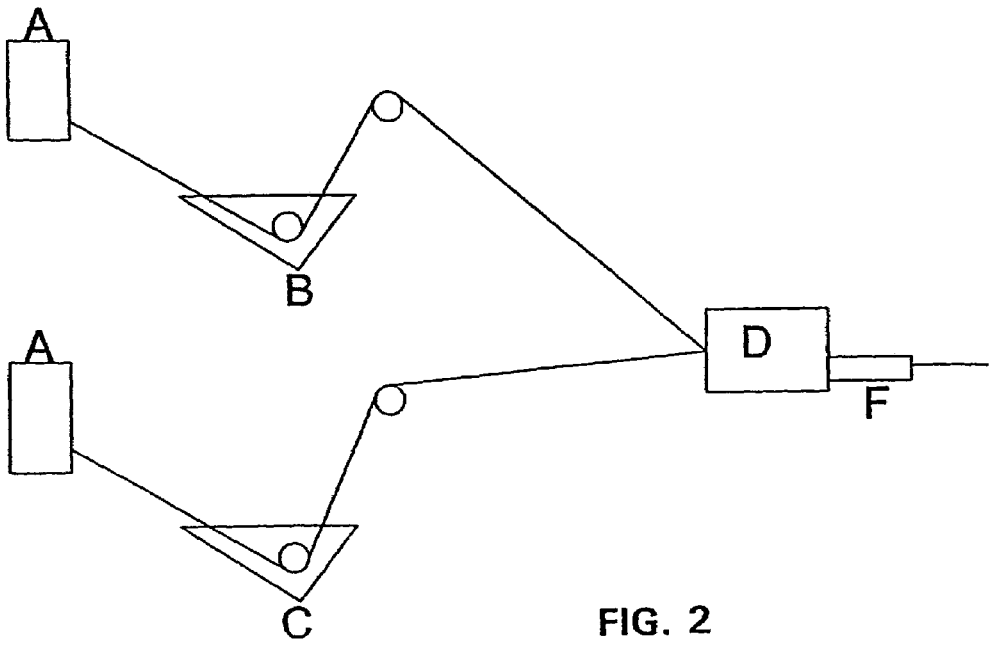
FIG. 2 is a schematic view of a method for manufacturing a dewatering foil for a paper or board machine.

According to the diagram of the manufacturing method shown in FIG. 2, reinforcements A of the surface layer, i.e. the adhesion layer 11 of the foil 10, of the body 13 of the dewatering member 10 shown in FIG. 1 are passed into a bath B, which is a resin bath containing a filler, and into a second resin bath C which does not contain any filler. From the resin baths B, C the structure is conducted in layers into a pultrusion die D, so that the fiber-containing material passed from the separate resin bath B will be in the pultrusion process D on the surface of the dewatering foil 10, i.e. of a finished profile F. By this means, the composite body 13 is provided with an adhesion layer 11, which composite body is finally coated with a hard coating layer 12 by thermal spraying. The resin alloy in the bath B comprises metallic, e.g. nickel-chromium particles/fillers, which are thus passed to the surfaces of the body 13 of the dewatering member and, when needed, to the edges.

In accordance with the invention, a filler-containing adhesion layer material is passed from the separate bath B to the surface area of the composite body 13 to a depth of at least one millimeter, most advantageously to a depth of 1-4 mm, thereby providing an even adhesion layer 11, for example, a nickel-chromium surface, to which the thermal spraying of the hard surface layer 12 adheres. The adhesion particle can also be of the same material as the coating itself. The fillers of the adhesion layer 11 are incorporated such that the desired outer surfaces of the wearing surface of the body 13 of the dewatering member 10 are of the desired adhesion material.

Thus, the method in accordance with the invention comprises three working steps: manufacturing a composite body with its adhesion layer, adding a coating to it by thermal spraying, and grinding the foil.

We claim:

1. A dewatering member for a paper or board machine, comprising:

an integrally formed pultruded composite body having an inner portion and an outer portion, wherein the outer portion is continuous with the inner portion, and wherein both the inner portion and the outer portion have parallel extending reinforcement fibers within resin, and wherein the outer portion has an adhesion improving agent locked into said reinforcement fiber-resin structure; and a uniform hard surface layer adhered to the outer portion of the composite body.

2. The dewatering member of claim 1 wherein the inner portion of the composite body does not contain the adhesion improving agent.

3. The dewatering member of claim 1 wherein the hard surface layer is a thermally sprayed coating of nickel-chromium.

4. The dewatering member of claim 3 further comprising a further layer of thermally sprayed ceramic on the nickel-chromium layer.

5. The dewatering member of claim 3 further comprising a further layer of metal.

6. The dewatering member of claim 1, wherein the adhesion improving agent is a metal powder.

7. The dewatering member of claim 6, wherein the metal powder comprises nickel-chromium.

8. The dewatering member of claim 6 wherein the metal powder is over 50 wt. % of the portion of the resin quantity of the outer portion.

9. The dewatering member of claim 1, wherein the hard surface layer is a thermal sprayed layer.

10. The dewatering member of claim 1 wherein the outer portion of the composite body has a thickness of at least 1 mm.

11. A dewatering member for a paper or board machine, comprising:

an integrally formed pultruded composite body having an inner portion and an outer portion, wherein the outer portion is continuous with the inner portion, and wherein both the inner portion and the outer portion have parallel extending reinforcement fibers within resin, wherein the outer portion has an adhesion improving filler locked into said reinforcement fiber-resin structure, and the inner portion resin does not contain any filler; and a uniform hard surface layer adhered to the outer portion of the composite body.

12. The dewatering member of claim 11 wherein the hard surface layer is a thermally sprayed coating of nickel-chromium.

13. The dewatering member of claim 12 further comprising a further layer of thermally sprayed ceramic on the nickel-chromium layer.

14. The dewatering member of claim 12 further comprising a further layer of metal.

15. The dewatering member of claim 11, wherein the adhesion improving filler comprises a nickel-chromium or tungsten powder.

16. The dewatering member of claim 11 wherein the outer portion of the pultrusion structure has a thickness of at least 1 mm.

17. The dewatering member of claim 11 wherein the adhesion improving filler is over 50 wt. % the portion of the resin quantity of the composite body outer portion.

* * * * *